United States Patent [19]

MacLagan

[11] Patent Number: 4,851,971

[45] Date of Patent: Jul. 25, 1989

[54] TRANSPARENCY ILLUMINATOR

[76] Inventor: James A. MacLagan, 1492 Tyrell, Park Ridge, Ill. 60068

[21] Appl. No.: 208,873

[22] Filed: Jun. 20, 1988

[51] Int. Cl.[4] ..... F21V 3/00

[52] U.S. Cl. ..... 362/97; 40/564; 40/574; 362/311; 362/455

[58] Field of Search ..... 362/97, 238, 236, 311, 362/367, 125, 310, 433, 455; 40/152.2, 564, 574; 353/119, 120, 122, DIG. 65

[56] References Cited

U.S. PATENT DOCUMENTS

| | | | |
|---|---|---|---|
| 3,418,738 | 12/1968 | Goodman | 40/574 |
| 3,771,245 | 11/1973 | Mabrey et al. | 40/564 |
| 4,267,657 | 5/1981 | Kloke | 40/574 |
| 4,380,880 | 4/1983 | Gandy | 40/152.2 |
| 4,516,343 | 5/1985 | Stilling | 40/564 |
| 4,602,448 | 7/1986 | Grove | 362/97 |
| 4,759,143 | 7/1988 | Pomerleau | 40/564 |
| 4,766,685 | 8/1988 | Kramer | 40/564 |

*Primary Examiner*—Ira S. Lazarus
*Assistant Examiner*—D. M. Cox
*Attorney, Agent, or Firm*—Silverman, Cass, Singer & Winburn, Ltd.

[57] ABSTRACT

An improved front loading transparency illuminator having a transparency retaining frame with a side wall mounting flange and an open, substantially perpendicular transparency receiving channel. The multipiece frame includes an internal channel for connecting adjacent pieces of the frame to one another prior to assembly onto the illuminator light box. The frame includes an outer open trim channel which has retaining lips to retain decorative inlay trim therein.

14 Claims, 1 Drawing Sheet

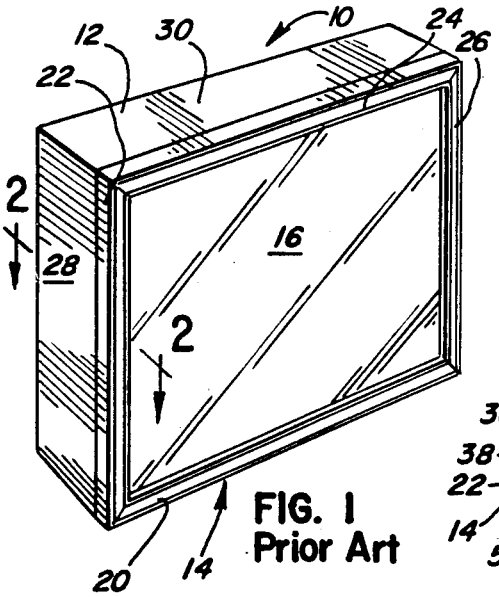
FIG. 1
Prior Art
FIG. 2 Prior Art
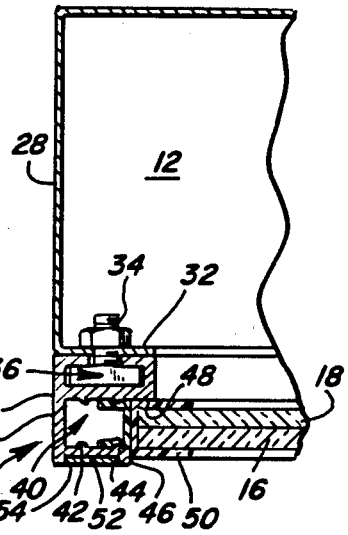
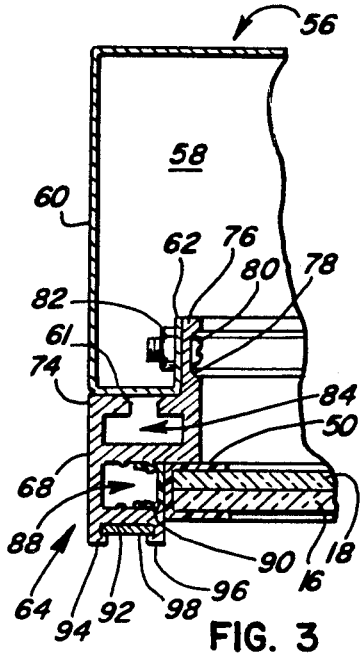
FIG. 3
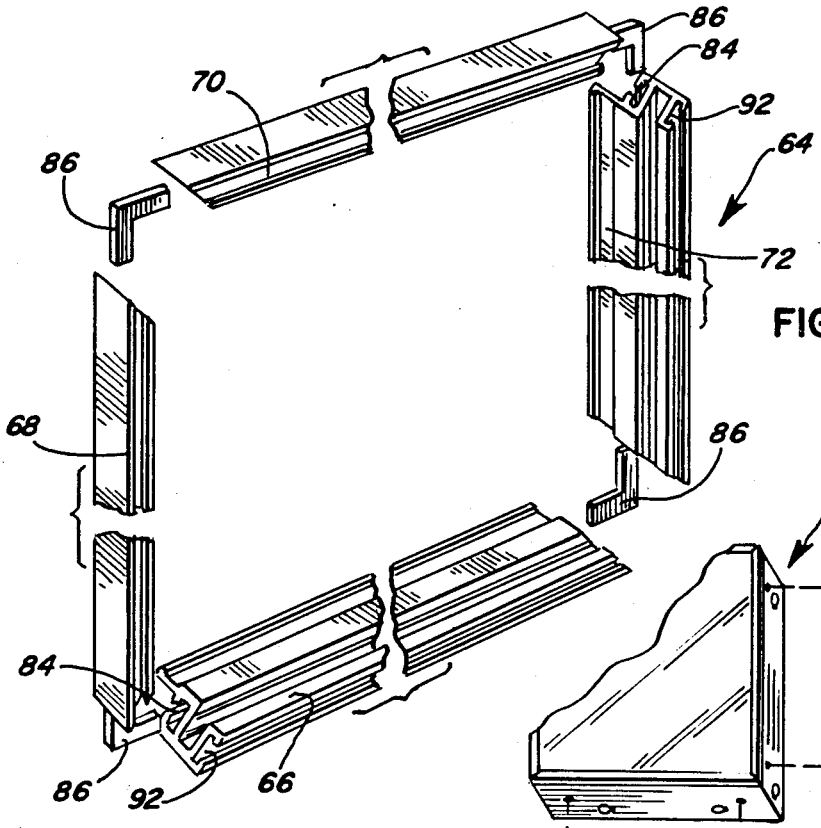
FIG. 4
FIG. 5
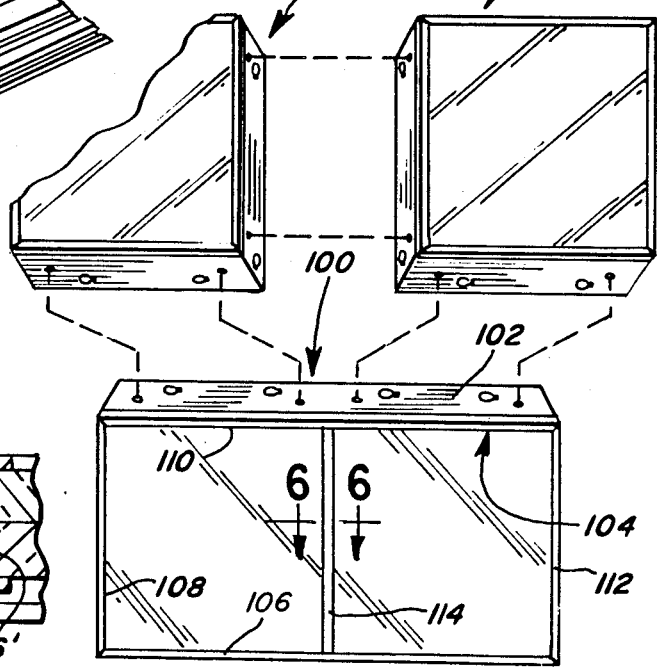
FIG. 6
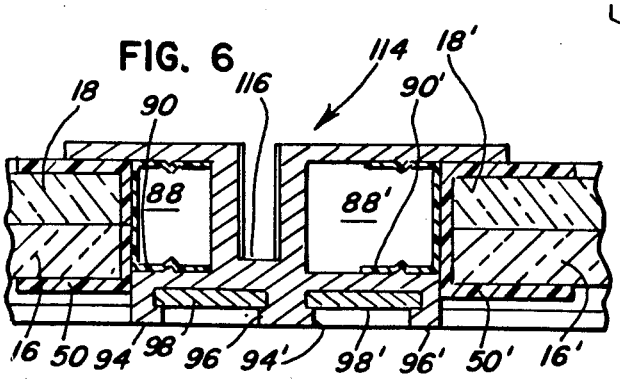

TRANSPARENCY ILLUMINATOR

BACKGROUND OF THE INVENTION

The invention relates generally to transparency illuminators and more particularly to an improved front loading transparency illuminator which is easily assembled.

Numerous prior art transparency illuminating systems have been utilized. These units generally capture the transparency holding structure, such as a pair of transparent plastic sheets with the transparency therebetween, on all four sides. Generally, the transparency holding structure is hingedly mounted for loading or includes a side loading feature. Such structures do not allow the illuminating structures to be stacked or nested together.

One prior art transparency illuminator includes a front loading transparency structure which was designed by Applicant and is manufactured by the assignee of the present application. This structure can be stacked and is an improvement over the prior side loading structures, but is difficult to manufacture as will be described with respect to FIGS. 1 and 2 hereinafter.

SUMMARY OF THE INVENTION

The above and other disadvantages of prior art transparency illuminating systems and structures are overcome in accordance with the present invention by providing an improved transparancy illuminator which easily is assembled. The illuminator includes a transparency retaining frame mounted to a light box by a side wall mounting flange. The frame can be preassembled for mounting onto the light box.

The multipiece frame includes a plurality of members, one for each side of the light box, each having an internal channel for connecting adjacent side members to one another prior to mounting onto the light box. Each member includes an open transparency receiving channel, opening substantially perpendicular to the mounting flanges. The members also include an outer open trim channel which includes retaining lips to retain decorative trim therein, which trim also can be preassembled in the frame.

BRIEF DESCRIPTION OF THE DRAWINGS

FIG. 1 is a perspective view of Applicant's prior art transparency illuminator;

FIG. 2 is a partial side sectional view of the illuminator of FIG. 1 taken along the line 2—2 therein;

FIG. 3 is a partial side sectional view of the improved transparency illuminator of the present invention;

FIG. 4 is an exploded perspective view of the multipart frame of the invention;

FIG. 5 is a perspective view illustrating stacking of the illuminators; and

FIG. 6 is a partial side sectional view of a double sided frame member of the invention.

DESCRIPTION OF THE PREFERRED EMBODIMENTS

Referring to FIGS. 1 and 2, Applicant's prior art transparency illuminator is designated generally by the reference numeral 10. The illuminator 10 includes a light box 12 with a transparency retaining frame 14 mounted thereto. The box 12 includes a source of light, such as a plurality of fluorescent bulbs, which illuminate a transparency (not illustrated) mounted between a pair of transparent plastic sheets 16 and 18.

The frame 14 is a multipart frame which includes a plurality of separate frame members 20, 22, 24 and 26, each separately mounted on a side of the box 12, only two of which are shown, a side 28 and a top 30. Referring to Fig. 2, the side 28 and the frame member 22 mounted thereto are illustrated in detail. Each of the other sides and frame members are similarly constructed.

The side 28 includes a flange wall or lip 32 extending substantially perpendicular thereto. The frame member 22 is mounted onto the flange wall 32 by a bolt and nut assembly 34. Each of the frame members is separately mounted to its respective flange wall. The frame members have to be blindly mounted, since the flange wall 32 is perpendicular to the outside of the box 12 and the depth of the box 12 does not permit the assembler to see the underneath side thereof. This results in a very time consuming operation, to blindly locate the assembly 34 and mount the member 22 to the flange 32. The assembly 34 is retained in an internal channel 36.

The member 22 includes an outer wall 38, which forms a coextensive wall with the side wall 28. The member 22 also includes an open channel 40. As illustrated, for the side wall 28, the channel 40 which includes a plurality of internal ridges 42 is filled with a filler wall 44. An outer wall 46 of the member 22 is shorter than an inner wall 48, which allows a bracket 50 to rest against the wall 48 adjacent the wall 46. The bracket 50 holds the two sheets 16 and 18 and transparency therebetween together.

The corresponding channels 40 in the top and bottom frame members 24 and 30 are not filled with the filler wall 44 or are only partially filled therewith. This allows the two sheets 16 and 18 to be inserted therein, by slightly bowing the plastic sheets to front load the transparency in the illuminator 10.

The outer wall 46 includes an outer open channel 52 into which is secured a trim strip 54. The trim strip 54 is glued or otherwise secured in the channel 52. This presents a number of problems, since some types of trim strips cannot easily be secured in the open channel 52. Also, if an adhesive is placed in the channel 52, the assembler must be careful to apply a uniform non-excessive amount and to correctly locate the strip therein. Further the strip 54 can become dislodged in whole or part which is unsightly.

The disadvantages of the prior ar transparency illuminator system are overcome by an improved transparency illuminator of the invention designated generally by the reference numeral 56 in FIG. 3. The illuminator 56 includes a light box 58, a side wall 60 of which is illustrated. The side wall 60 includes an L-shaped mounting flange 61 having a dependent side wall 62, parallel to the side wall 60.

The illuminator 56 includes a multipart frame 64 having frame members 66, 68, 70 and 72 as illustrated in FIG. 4. Each of the frame members 66, 68, 70 and 72 is substantially identical and only the member 68 will be described in detail, referring again to FIG. 3.

The member 68 again includes an outer wall 74 which forms a wall coextensive with the side wall 60. The member 68 includes a side wall mounting flange 76 which depends from the member 68 adjacent the flange wall 62. The flange 76 includes a groove 78, which allows a self-tapping screw 80 to be inserted therethrough and through the wall 62 without interfering with light from the box 58. The side mounting of the frame 62 allows automatic tools easily to be utilized. The screw 80 also could be a bolt and include a nut 82, included for illustration only.

The member 68 includes an internal channel 84, which is utilized to preassemble the frame 64, before it is mounted onto the box 58. The members 66, 68, 70 and 72 each include the channel 84 and each adjacent open end is mated together by a simple L-shaped bracket 86 (FIG. 4) which is inserted therein and secured thereto by any convenient securing means such as the screw 80. The resulting frame 64 is thus preassembled and then easily can be mounted onto the light box 58 with the screws 80. The depending flange 76 provides a structure which is readily available and can be easily visually aligned with the frame 64. This substantially reduces the assembly time of the illuminator 56 over the prior art illuminator 10.

Referring again to FIG. 3, the member 68 again includes an open channel 88 substantially the same as the channel 40. Again, a filler wall 90 can be inserted in the side wall 68 and the sheets 16 and 18 are secured against the member 68 as before. The member 68 includes an outer trim channel 92 as before; however, the channel 92 includes a pair of retaining lips 94 and 96. An inlay trim strip 98 then can be assembled into the member 68 when the frame 64 is assembled without any adhesive. Thus, any type of metal or plastic inlay trim strip can be utilized which is completely secured and will not peel off the frame 64, as can the strip 52.

Referring to FIG. 5, the front loading illuminators 10 or 56 can be stacked or nested and secured together, as illustrated. Additionally, a double transparency illuminator 100 can be formed, which includes a single box 102 and a frame 104 which includes outer frame pieces 106, 108, 110 and 112. These frame pieces are identical to the frame piece 68 illustrated in FIG. 3. In addition, the frame 104 includes a double sided frame piece 114 across the center thereof, which is best illustrated in FIG. 6.

The double sided frame piece 114 would be mounted between the frames pieces 106 and 110 and hence does not include the channel 84 and the flange 76, but in other respects is substantially identical to the member 68 and the same numerals are utilized to identify substantially the same elements in the frame piece 114. The two opposed channels 88 and 88' are joined together at a common wall 116. The same sized transparency thus can be utilized in both sides of the double transparency illuminator 100.

Modifications and variations of the present invention are possible in light of the above teachings. The frame members preferably are formed of extruded metal. It is therefore to be understood that within the scope of the appended claims, the invention may be practiced otherwise then as specifically described.

What is claimed and desired to be secured by Letters Patent of the United States is:

1. An improved transparency illuminator comprising:

a light box having a plurality of side walls, each side wall including an L-shaped flange extending therefrom to provide a frame mounting flange wall spaced from and substantially parallel to said side wall; and a multipiece transparency retaining frame mounted onto said side walls, each said frame piece including a side wall mounting flange mounted to said flange wall and a transparency receiving channel opening substantially perpendicular to said mounting flange and said side wall and further including an outer trim channel in each said frame piece opening perpendicular to said side wall and including overlying retaining lips to retain decorative inlay trim therein.

2. The illuminator as defined in claim 1 further including means for preassembling said frame pieces into a single multipiece frame unit.

3. The illuminator as defined in claim 2 wherein said preassembly means further include an internal channel in each said frame piece for connecting adjacent flange pieces to one another.

4. The illuminator as defined in claim 3 wherein said preassembly means further include an L-shaped corner member inserted into adjacent internal channels of each said frame piece and secured therein to form said multipiece frame into a single unit for mounting onto said box.

5. The illuminator as defined in claim 1 wherein each said frame piece includes an outer wall substantially parallel to said mounting flange and mounted onto said flange wall substantially parallel with said side wall and forming an extension thereof.

6. The illuminator as defined in claim 1 wherein each said frame piece is an integral extruded metal member.

7. An improved front loading transparency illuminator, including a light box having a plurality of side walls, each of the side walls including a substantially perpendicular flange extending therefrom, said side walls formed into a predetermined rectangular shape, said light box having a source of light therein, said improvement comprising:

the light box side walls including a further frame mounting flange wall formed substantially perpendicular to said side wall flange and substantially parallel to said side wall; and a preassembled multipiece transparency retaining frame mounted onto said side walls, each said frame piece including a side wall mounting flange mounted to said flange wall and a transparency receiving channel opening substantially perpendicular to said mounting flange and said side wall, including means for preasembling said frame pieces into a single multipiece frame unit and further including an outer trim channel in each said frame piece opening perpendicular to said side wall and including overlying retaining lips to retain decorative inlay trim therein.

8. The illuminator as defined in claim 7 wherein said preassembly means further include an internal channel in each said frame piece for connecting adjacent flange pieces to one another and an L-shaped corner member inserted into adjacent internal channels of each said frame piece and secured therein to form said multipiece frame into a single unit for mounting onto said box.

9. The lluminator as defined in claim 7 wherein each said frame piece is an integral extruded metal member.

10. An improved multipiece frame for a front loading preassembled transparency illuminator, including a light box having a plurality of side walls, each of the side walls including a substantially perpendicular flange extending therefrom, said side walls formed into a predetermined rectangular shape, said light box having a source of light therein, said improvement comprising:

the light box having a plurality of side walls, each side wall including an L-shaped flange extending therefrom to provide a frame mounting flange wall spaced from and substantially parallel to said side wall; and a multipiece transparency retaining frame adapted to be mounted onto said side walls, each said frame piece is an integral extruded metal member including a side wall mounting flange mounted to said flange wall and a transparency receiving channel opening substantially perpendicular to said mounting flange and said side wall and including means for preassembling said frame piece into a single multipiece frame unit and further including an outer trim channel in each said frame piece opening perpendicular to said side wall and including overlying retaining lips to retain decorative inlay trim therein.

11. The frame as defined in claim 10 wherein said preassembly means further include an internal channel in each said frame piece for connecting adjacent flange pieces to one another and an L-shaped corner member inserted into adjacent internal channels of each said frame piece and secured therein to form said multipiece frame into a single unit for mounting onto said box.

12. An improved transparency illuminator comprising:

a light box having a plurality of side walls, each side wall including an L-shaped flange extending therefrom to provide a frame mounting flange wall spaced from and substantially parallel to said side wall; and a multipiece transparency retaining frame mounted onto said side walls, each said frame piece including a side wall mounting flange mounted to said flange wall and a transparency receiving channel opening substantially perpendicular to said mounting flange and said side wall and further including an outer trim channel in each said frame piece opening perpendicular to said side wall and including overlying retaining lips to retain decorative inlay trim therein, said frame formed in a rectangle and further including a double sided frame piece secured between an opposite pair of said frame pieces to form a double transparency retaining frame, said double sided frame piece including a transparency receiving channel opening on both sides thereof.

13. An improved front loading transparency illuminator, including a light box having a plurality of side walls, each of the side walls including a substantially perpendicular flange extending therefrom, said side walls formed into a predetermined rectangular shape, said light box having a source of light therein, said improvement comprising:

the light box side walls including a further frame mounting flange wall formed substantially perpendicular to said side wall flange and substantially parallel to said side wall; and a preassembled multipiece transparency retaining frame mounted onto said side walls, each said frame piece including a side wall mounting flange mounted to said flange wall and a transparency receiving channel opening substantially perpendicular to said mounting flange and said side wall, including means for preassembling said frame pieces into a single multipiece frame unit and further including an outer trim channel in each said frame piece opening perpendicular to said side wall and including overlying retaining lips to retain decorative inlay trim therein, said frame formed in a rectangle and further including a double sided frame piece secured between an opposite pair of said frame pieces to form a double transparency retaining frame, said double sided frame piece including a transparency receiving channel opening on both sides thereof.

14. An improved multipiece frame for a front loading preassembled transparency illuminator, including a light box having a plurality of side walls, each of the side walls including a substantially perpendicular flange extending therefrom, said side walls formed into a predetermined rectangular shape, said light box having a source of light therein, said improvement comprising:

the light box having a plurality of side walls, each side wall including an L-shaped flange extending therefrom to provide a frame mounting flange wall spaced from and substantially parallel to said side wall; and a multipiece transparency retaining frame adapted to be mounted onto said side walls, each said frame piece is an integral extruded metal member including a side wall mounting flange mounted to said flange wall and a transparency receiving channel opening substantially perpendicular to said mounting flange and said side wall and including means for preassembling said frame piece into a single multipiece frame unit and further including an outer trim channel in each said frame piece opening perpendicular to said side wall and including overlying retaining lips to retain decorative inlay trim therein, said frame formed in a rectangle and further including a double sided frame piece secured between an opposite pair of said frame pieces to form a double transparency retaining frame, said double sided frame piece including a transparency receiving channel opening on both sides thereof.

* * * * *